United States Patent [19]

Park et al.

[11] Patent Number: 4,795,993

[45] Date of Patent: Jan. 3, 1989

[54] MATCHED DUAL MODE WAVEGUIDE CORNER

[75] Inventors: Pyong K. Park, Canoga Park; Robert L. Eisenhart, Woodland Hills, both of Calif.

[73] Assignee: Hughes Aircraft Company, Los Angeles, Calif.

[21] Appl. No.: 30,767

[22] Filed: Mar. 26, 1987

[51] Int. Cl.[4] ..... H01P 1/02

[52] U.S. Cl. ..... 333/249; 333/33

[58] Field of Search ..... 333/21 R, 21 A, 22 R, 333/248, 249, 251, 253, 33

[56] References Cited

U.S. PATENT DOCUMENTS

| | | | |
|---|---|---|---|
| 2,364,371 | 12/1944 | Katzin | 333/21 A X |
| 2,829,352 | 4/1958 | Hennies et al. | 333/223 X |
| 2,853,688 | 9/1958 | Leboutet | 333/22 R X |
| 3,087,130 | 4/1963 | Marcatili | 333/249 |
| 3,219,955 | 11/1965 | Inoue et al. | 333/249 |
| 3,327,250 | 6/1967 | Sleeper, Jr. | 333/21 R |

FOREIGN PATENT DOCUMENTS

| | | | |
|---|---|---|---|
| 2424010 | 11/1975 | Fed. Rep. of Germany | 333/249 |

*Primary Examiner*—Paul Gensler

*Attorney, Agent, or Firm*—R. A. Hays; C. D. Brown; A. W. Karambelas

[57] ABSTRACT

A polarized, mitered corner (32) is constructed using a multiple surface reflector in a square waveguide corner. The multiple surface reflector (34) provides a mitered corner having one effective miter size for the E-plane mode and a different effective miter size for the H-plane mode (42, 44). The surfaces may comprise ridges which are parallel to the E-field in one of the two modes, so that the ridges behave as the reflecting surface for that mode while the backplane, upon which the ridges are formed, serves as the reflecting surface for the other mode. An alternate embodiment wherein the two reflecting surface comprise a plurality of parallel wires, is also disclosed.

19 Claims, 5 Drawing Sheets

MATCHED DUAL MODE WAVEGUIDE CORNER

BACKGROUND OF THE INVENTION

1. Field of the Invention

The present invention relates generally to waveguides and more particularly to a polarized mitered corner for square waveguides which provides a match for both orthogonal modes ($TE_{10}$ and $TE_{01}$) simultaneously.

2. Description of Related Art

Square waveguides are often used in dual polarization applications, since square waveguides can support two orthogonal modes ($TE_{10}$ and $TE_{01}$) with identical phase velocity. In constructing practical waveguide systems, it is often necessary to provide a bend or corner where two sections of waveguide join at some angle other than a straight line. Well matched bends or corners are often difficult to achieve, due to the complexities involved in changing the direction of propagation within the waveguide system. A right angle bend or corner is one of the most difficult to achieve. Traditionally, a right angle corner is implemented by constructing a mitered corner which provides a diagonally oriented reflecting surface for changing the direction of the propagating electromagnetic energy and causing it to round the corner or bend. Corners other than right angle corners are implemented in the same way.

There can be a great deal of mismatch associated with each corner or bend in the waveguide system. To minimize this mismatch, the traditional mitered corner is carefully tuned by selecting the proper miter size for minimum mismatch. Although this can be done in rectangular waveguide systems which are designed to support a single propagation mode (typically the $TE_{10}$ mode), the same is not true for square waveguides designed for dual mode operation.

In square waveguide systems for simultaneously supporting dual propagation modes, the simple mitered corner is less effective. This is largely due to the fact that the $TE_{10}$ mode and the $TE_{01}$ mode behave differently when reflecting from the mitered corner and inherently require different miter sizes. If the mitered corner is designed for optimal E-plane performance (tuned to the $TE_{01}$ mode), it will not have optimal performance for the H-plane mode, and vice versa. The prior art has failed to adequately address this problem.

SUMMARY OF THE INVENTION

The present invention solves the aforementioned problem by providing a waveguide corner which is matched for dual mode operation. The invention provides first and second waveguides, such as square waveguides which are each capable of supporting two orthogonal modes of electromagnetic energy propagation simultaneously. The waveguides are joined together to define a corner. A reflecting means is positioned in the corner for reflecting the electromagnetic energy from the first waveguide to the second waveguide. The reflecting means has at least two polarized reflecting surfaces which are disposed in different transverse planes. One of the reflecting surfaces reflects one of the two orthogonal modes, while the other reflecting surface reflects the other of the orthogonal modes. Because the two reflecting surfaces lie in different transverse planes, they can each be designed for optimal performance, one for the E-plane and the other for the H-plane.

The reflecting means herein comprises a reflecting plane with at least one, and preferably several, elongated ridges projecting outwardly from the reflecting plane. The ridges are oriented generally parallel to one of the sidewalls, so that the mode having an E-field parallel to the ridges will reflect from the ridges, while the mode having an E-field perpendicular to the ridges, will propagate between the ridges and will reflect from the backwall on which the ridges are formed.

In an alternate embodiment, the reflecting planes are comprised of a plurality of conductive wires parallel to one another and located in two planes which are also parallel to one another.

For a more complete understanding of the invention, its objects and advantages, reference may be had to the following specification and to the accompanying drawings.

DESCRIPTION OF THE PREFERRED EMODIMENT

Figure 2:
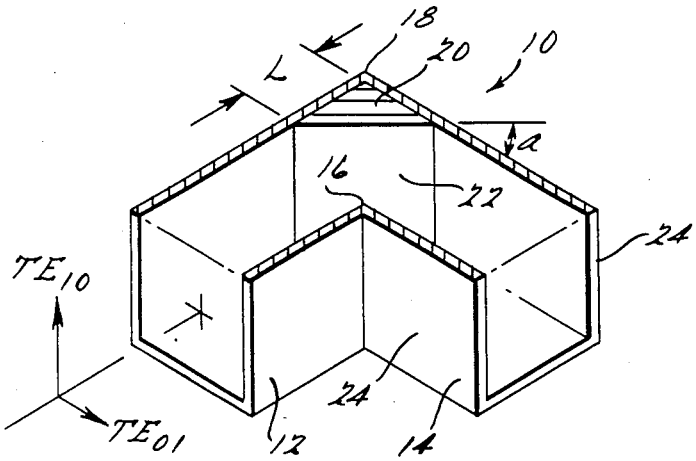
Prior Art FIG. 2.
FIG. 2 is a diagrammatic cross-sectional view of a prior art square corner, useful in explaining fundamental terminology.

In order to provide a basis for understanding the invention, reference will first be made to a prior art square waveguide right angle corner 10, shown in FIG. 2, which is constructed by joining first and second square waveguides 12 and 14 to form a right angle bend. The corner defines an inside corner 16 and an outside corner 18 where the two waveguides meet. Positioned in the outside corner 18 is a wedge-shaped reflecting means 20 which has a reflecting surface 22 which lies in a plane forming a 45 degree angle "a" with the plane of the upstanding sidewalls 24. The reflecting means 20 thus defines a mitered corner whose miter size is given by the dimension L.

Figure 1A:
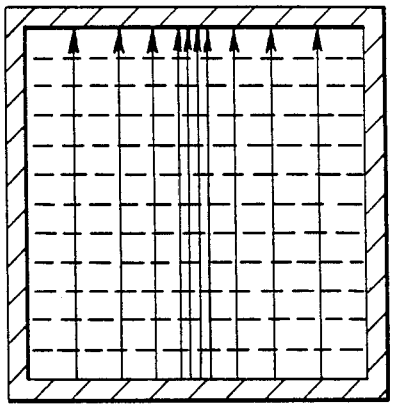
FIGS. 1A and 1B are cross-sectional views looking into the mouth of a sqaure waveguide, FIG. 1A illustrating the fields of the $TE_{10}$ mode and FIG. 1B illustrating the fields of the $TE_{01}$ mode.
Figure 1B:
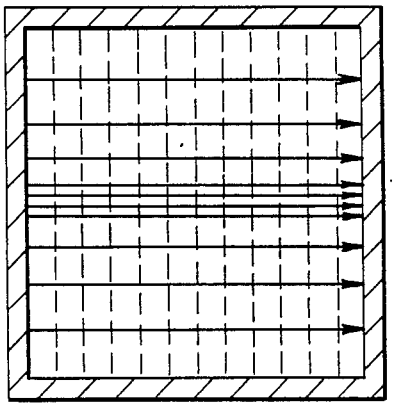

Square waveguides 12 and 14 are both capable of supporting two orthogonal modes of electromagnetic energy propagation simultaneously. These modes are the $TE_{10}$ mode or the H-plane mode and the $TE_{01}$ mode or the E-plane mode. FIGS. 1A and 1B illustrate the electric (solid) and magnetic (dashed) field configurations for the $TE_{10}$ and $TE_{01}$ modes. It will be seen that these two modes have essentially the same field configurations but oriented 90 degrees from one another.

For purposes of illustration, assume that both modes, $TE_{10}$ and $TE_{01}$ are introduced into the mouth of waveguide 12. Energy will be reflected back to the mouth of waveguide 12 for both modes. The presence of such reflected energy indicates a nonperfect match. The greater the amount of reflected energy, the less perfect is the match. The ratio of the amount of energy entering the mouth to the amount of energy reflected back to the mouth is called the "return loss." High values of return loss indicate a good match, i.e. a desirable condition. The return loss is frequency dependent and also dependent upon the miter size L.

Figure 3:
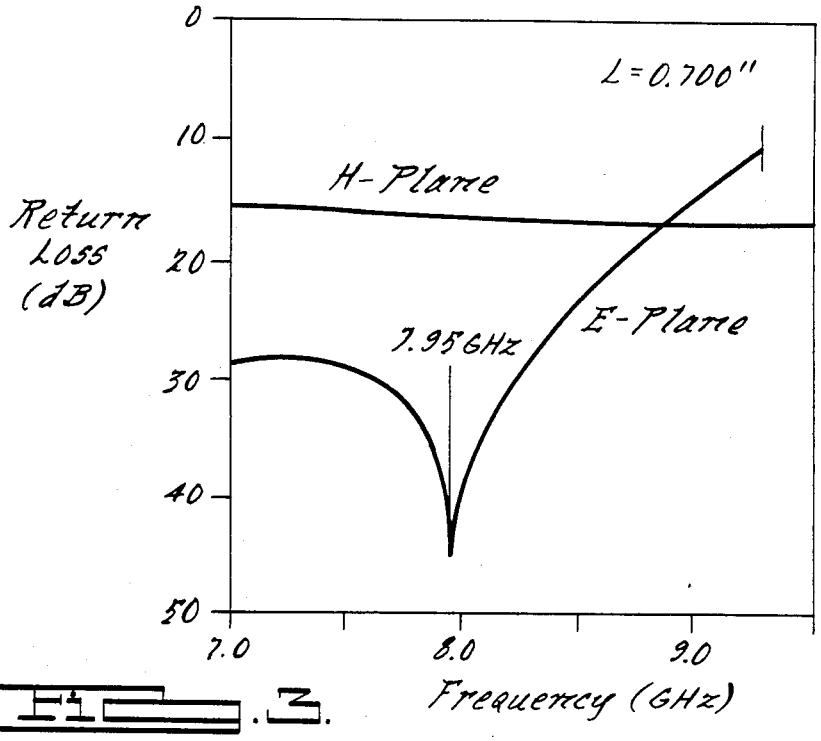
FIG. 3 is a graph of return loss versus frequency for a given mitered corner of the prior art optimized for the E-plane mode.
Figure 4:
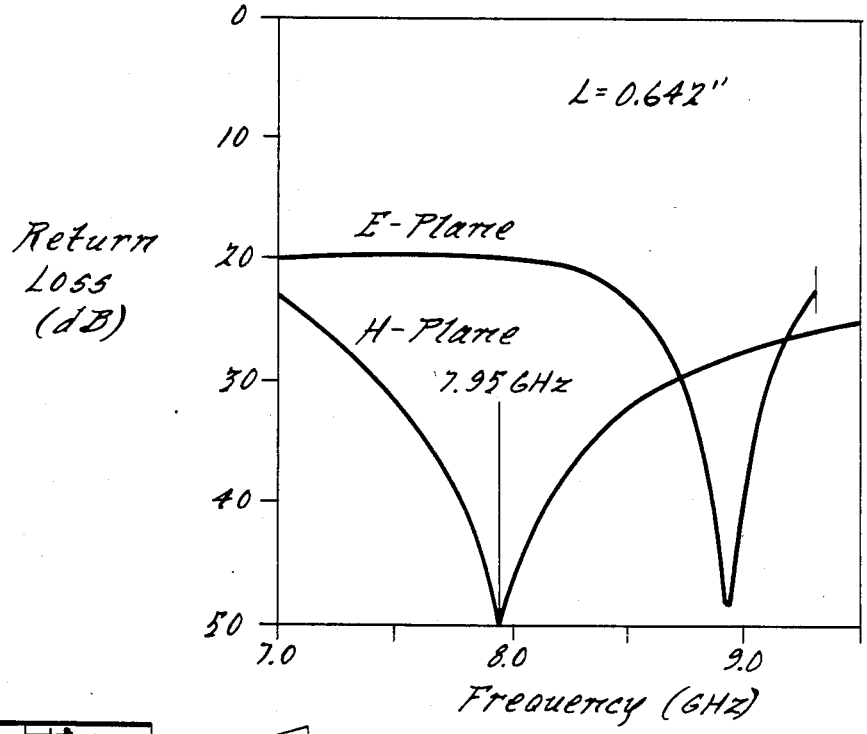
FIG. 4 is a similar graph of return loss versus frequency for a different mitered corner of the prior art optimized for the H-plane mode.

FIGS. 3 and 4 illustrate the way in which miter size affects the signal return loss as a function of frequency for L values which have been optimized for the E-plane and the H-plane modes respectively. These curves are representative of the results obtained using an X-band square wavegude corner of the configuration shown in FIG. 2. FIG. 3 depicts the return loss as a function of frequency for a miter size of 0.700 inches (each sidewall of the waveguide being 0.900 inches). FIG. 4 illustrates the results obtained using a miter size of 0.642 inches. The former case represents a corner which is tuned to provide an E-plane match, where as the latter case represents a corner tuned to provide an H-plane match. As seen by comparing FIGS. 3 and 4, the former case gives high return loss in the E-plane at the tuned frequency of approximately 7.95 GHz. The H-plane return loss is quite low in the former case. In the latter case, the H-plane return loss is at a maximum at 7.95 GHz, but the E-plane return loss at that frequency is comparatively low. The E-plane return loss is maximum at a comparatively higher frequency around 9 GHz.

Figure 5:
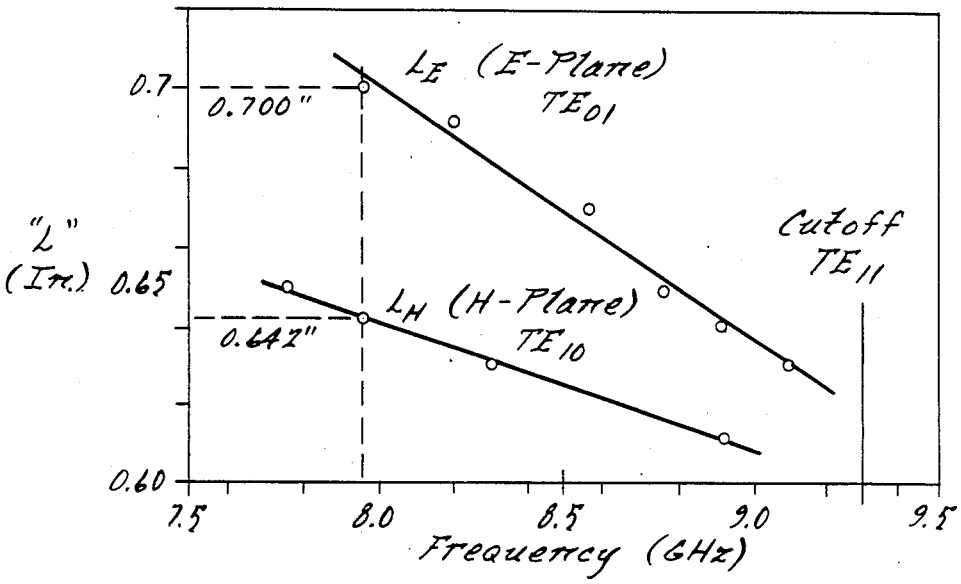
FIG. 5 is a graph of miter size versus frequency, illustrating the manner in which the miter size independently affects the $TE_{01}$ and $TE_{10}$ modes.

FIGS. 3 and 4 thus illustrate that in a conventional square waveguide mitered corner, the optimum miter size is not the same for the $TE_{01}$ mode (E-plane) and the $TE_{10}$ mode (H-plane). FIG. 5 illustrates experimentally determined design curves for such mitered corners, also illustrating that the optimum miter size depends upon which mode is being used.

Figure 6:
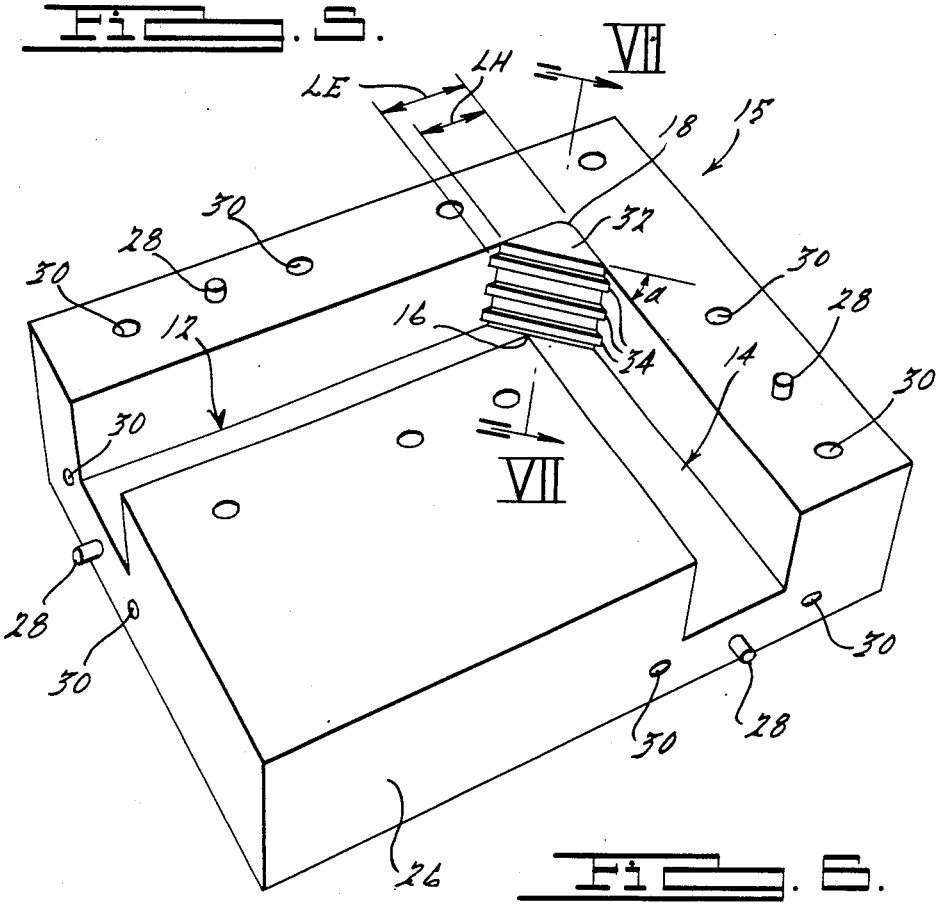
FIG. 6 is a perspective view of the matched dual mode waveguide corner of the invention, with the top wall removed for illustration purposes.

With this understanding of the prior art in mind, reference will now be made to FIGS. 6, 7 and 8 which depict the invention and illustrate its improved performance. Referring to FIG. 6, the invention comprises first and second square waveguides 12 and 14 which are joined to form a corner designated generally at 15, and comprising an inside corner 16 and an outside corner 18. As illustrated in FIG. 6, the waveguides and corner can be implemented using a metal block 26 which is machined to provide the requisite waveguides and corners described. It will be understood that the waveguide block 26 of FIG. 6 would also have a top wall (not shown) which covers the block 26. As a means for attaching and aligning such a top cover with the block 26, the block 26 includes a plurality of studs 28 and holes 30 for securing the cover in proper position.

Figure 7:
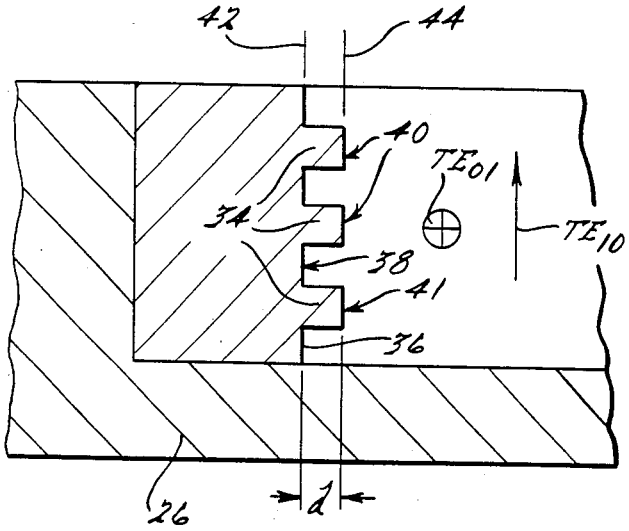
FIG. 7 is a cross-sectional view taken along the line VII—VII of FIG. 6 and illustrating the polarized, mitered corner in greater detail.

With reference to FIG. 7 and continued reference to FIG. 6, the dual mode waveguide corner employs a polarized reflecting corner 32. Corner 32 has a plurality of horizontal ridges 34 which project outwardly from the backplane 36 of the corner. Ridges 34 are parallel to one another and spaced apart a distance such that propagation between the ridges is cutoff for the mode of propagation in which the E-field is oriented parallel to the ridges. Backplane 36 defines a first reflecting surface 38 and the vertical walls of ridges 34 define a second reflecting surface 40.

As best seen in FIG. 7, reflecting surfaces 38 and 40 are disposed in different transverse planes 42 and 44. Reflecting surfaces 38 and 40 are spaced apart a distance d. The polarized reflecting corner is constructed so that one of the orthogonal modes (the $TE_{10}$ or H-plane mode) reflects from the first reflecting surface defined by backplane 36, while the other mode (the $TE_{01}$ or E-plane mode) reflects from the second reflecting surface 40 of ridges 34. Because of the spacing d between the two reflecting surfaces 38 and 40, the effective miter size for the H-plane is different than that of the E-plane.

Using trigonometry, it can be shown that the incremental difference in miter size between the H-plane and the E-plane is determined by the spacing d divided by the sine of the miter angle a.

By using the polarized reflecting corner 32 with raised ridges 34 oriented parallel to the E-field of the $TE_{01}$ mode, the effective shorting plane will be slightly behind the ridge tops, i.e. reflecting surface 40. The $TE_{10}$ mode, which has the E-field perpendicular to the ridges, is little influenced by the ridges and the effective shorting plane is approximately the original backplane reflecting surface 38. This produces an effective miter size $L_E$ for the $TE_{01}$ mode which is larger than the effective miter size $L_H$ for the $TE_{10}$ mode. The values for miter size L, set forth in FIG. 5, can be used for a close approximation to design the reflecting surfaces for proper match in both modes.

Figure 8:
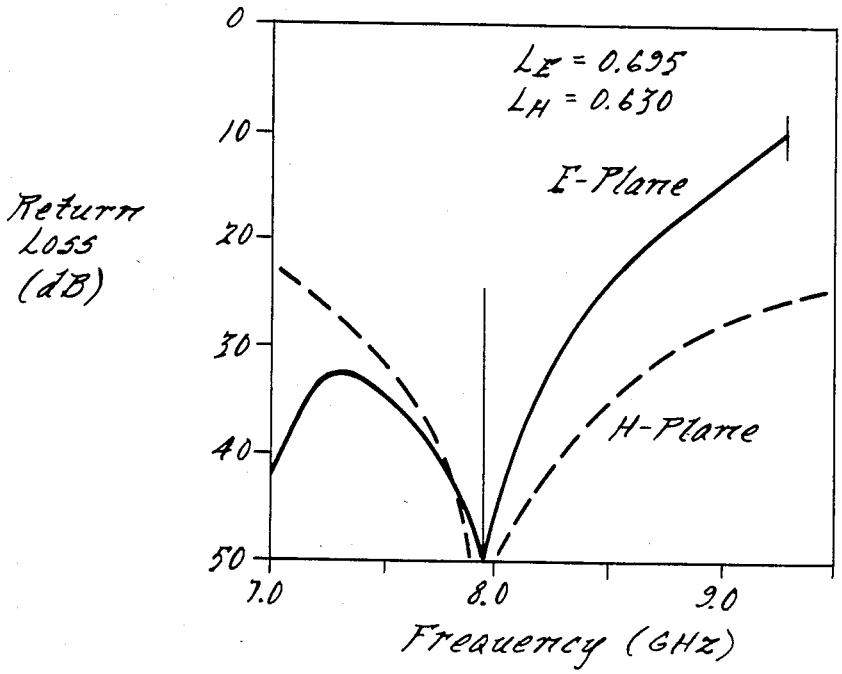
FIG. 8 is a graph of return loss versus frequency for the matched dual mode waveguide corner of the invention.

FIG. 8 illustrates an optimized, matched dual mode square waveguide corner using the principles of the invention. The curves in FIG. 8 were produced using an effective miter size $L_E$ of 0.695 inches and an effective miter size $L_H$ of 0.630 inches. As seen in FIG. 8, both the E-plane and the H-plane have a high return loss at the design frequency of 7.95 GHz. Comparing these optimized miter size values ($L_E$ and $L_H$) with the values obtainable from FIG. 5, it will be seen that the optimized values used to produce the curves of FIG. 8 do not exactly match those of FIG. 5. This is because there is a slight amount of interaction between the reflecting surface 38 and the reflecting surface 40. Thus in some instances, a minimal design iteration may be necessary to produce optimal results.

Using the corner illustrated in FIG. 5 with the stated miter sized for producing the results of FIG. 8, dual mode operation of the corner at 7.95 GHz showed a VSWR of less than 1.05 for both E-plane and H-plane operation over a band of approximately 1.0 GHz. Cross-polarization isolation was typically 30 dB across the 7 to 9.6 GHz band.

Figure 9:
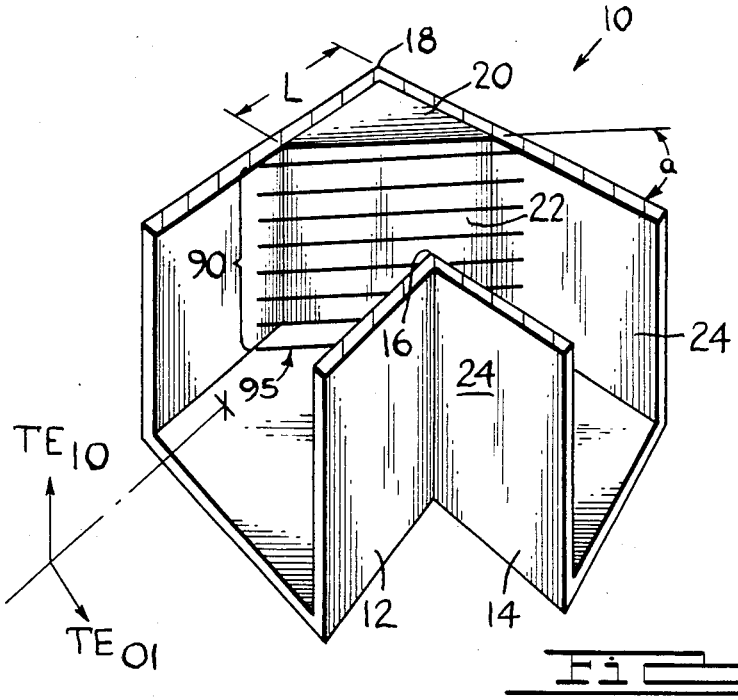
FIG. 9 illustrates an alternate embodiment wherein a plane of parallel wires replaces the ridges shown in FIG. 6 and FIG. 7.
Figure 10:
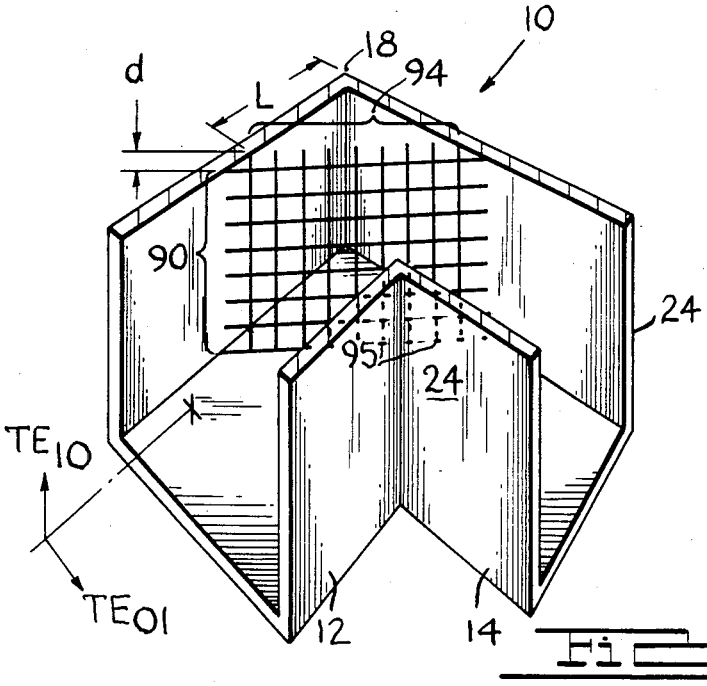
FIG. 10 shows use of two such planes of wires to serve as the required two reflecting surfaces.

While the invention has been illustrated in connection with a particular 90 degree mitered corner with a three-ridge reflector, it will be understood that the principles of the invention can be applied to a broad range of other configurations. An example of such other configurations is the use of a set (90 or 94) of parallel small gauge wires, forming a grid in a position to replace the tops of the physical ridges illustrated in FIGS. 6 and 7. Such sets of parallel wires 95 are shown in FIGS. 9 and 10. In FIG. 10, the two parallel planes of wires (90 and 94) are separated by a distance d analogous to the distance d shown in FIG. 7. In general, the use of more, but thinner ridges (wires) will provide a more precise correlation of measured results and the results plotted in FIG. 5. Accordingly, the invention is capable of certain modification and change without departing from the spirit of the invention as set forth in the appended claims.

What is claimed is:

1. A matched dual mode waveguide corner comprising:

first and second waveguides each for supporting two orthogonal modes of electromagnetic energy propagation;

said first and second waveguides being joined together to define a corner;

a reflecting means positioned in said corner for reflecting said electromagnetic energy from said first waveguide to said second waveguide;

said reflecting means having at least two polarized reflecting surfaces disposed in different transverse planes, wherein a first one of said reflecting surfaces reflects one of said orthogonal modes of electromagnetic energy and wherein a second one of said reflecting surfaces reflects the other of said orthogonal modes of electromagnetic energy.

2. The waveguide corner of claim 1 wherein said first and second waveguides are both square waveguides.

3. The waveguide corner of claim 1 wherein said corner is a ninety degree corner.

4. The waveguide corner of claim 1 wherein said waveguides have orthogonal sidewalls and said reflecting means comprises a reflecting plane and at least one elongated ridge projecting outwardly from said reflecting plane, said ridge being oriented generally parallel to one of said sidewalls.

5. The waveguide corner of claim 2 wherein said waveguides have orthogonal sidewalls and wherein said reflecting surfaces are disposed in transverse planes which are orthogonal to at least one of said sidewalls.

6. The waveguide corner of claim 1 wherein said waveguides each simultaneously support two orthogonal modes of electromagnetic energy propagation.

7. The waveguide corner of claim 1 wherein said waveguides each support the $TE_{10}$ mode and the $TE_{01}$ mode.

8. The waveguide corner of claim 1 wherein said first reflecting surface is a predetermined first distance from a reference point on said corner and said second reflecting surface is a predetermined second distance from said reference point, said first and second distances being such that the tuned frequency of said waveguide corner is substantially the same for both of said orthogonal modes.

9. The waveguide corner of claim 1 wherein said reflecting means includes a plurality of spaced apart parallel ridges.

10. The waveguide corner of claim 9 wherein said ridges are spaced apart a distance such that propagation between said ridges is cutoff for the mode of propagation in which the E-field is oriented parallel to said ridges.

11. A matched dual mode waveguide comprising:

a waveguide having a bend for supporting at least two orthogonal modes of electromagnetic energy propagation and for defining a common energy propagation path therefor;

a reflecting means positioned in said waveguide proximate said bend for redirecting said common energy propagation path;

said reflecting means defining a backplane and having at least one ridge means extending outwardly from said backplane; and said backplane providing a first reflecting surface for one of said orthogaonl modes and said ridge means providing a second reflecting surface for another of said orthogonal modes.

12. The waveguide of claim 11 wherein said first and second reflecting surfaces lie in different planes.

13. The waveguide of claim 11 wherein said first and second reflecting surfaces lie in different parallel planes.

14. The waveguide of claim 11 wherein said waveguide is a square waveguide.

15. The waveguide of claim 11 wherein said waveguide has orthogonal sidewalls and said ridge means is oriented generally parallel to one of said sidewalls.

16. The waveguide of claim 11 wherein said reflecting means has a plurality of ridges extending outwardly from said backplane.

17. The waveguide of claim 11 wherein said reflecting means has a plurality of parallel and spaced apart ridges extending outwardly from said backplane.

18. The waveguide of claim 17 wherein said ridges are spaced apart a distance such that propagation between said ridges is cutoff for a mode of propagation in which the E-field is oriented parallel to said ridges.

19. The waveguide corner of claim 11 wherein said reflecting means includes a plurality of spaced apart parallel wires.

* * * * *